US009439499B1

(12) United States Patent
Burger

(10) Patent No.: US 9,439,499 B1
(45) Date of Patent: Sep. 13, 2016

(54) COSMETICS RETRIEVAL DEVICE AND APPLICATOR

(71) Applicant: Shawna Burger, Frisco, TX (US)

(72) Inventor: Shawna Burger, Frisco, TX (US)

( * ) Notice: Subject to any disclaimer, the term of this patent is extended or adjusted under 35 U.S.C. 154(b) by 0 days.

(21) Appl. No.: 14/918,164

(22) Filed: Oct. 20, 2015

Related U.S. Application Data

(60) Provisional application No. 62/145,610, filed on Apr. 10, 2015.

(51) Int. Cl.
*A45D 34/04* (2006.01)
*A45D 40/26* (2006.01)
*A45D 40/00* (2006.01)

(52) U.S. Cl.
CPC ..... *A45D 40/262* (2013.01); *A45D 34/046* (2013.01); *A45D 2040/0006* (2013.01)

(58) Field of Classification Search
CPC ..... A45D 34/045; A45D 34/046; A45D 40/265; A45D 40/267
USPC ..... 401/126–130
See application file for complete search history.

(56) References Cited

U.S. PATENT DOCUMENTS 4,165,755 A * 8/1979 Cassai ..... A45D 40/265 132/218
4,428,388 A * 1/1984 Cassai ..... A46B 9/021 132/218
5,328,282 A * 7/1994 Charrier ..... A45D 34/048 401/127
5,816,728 A * 10/1998 Nardolillo ..... A45D 40/265 132/218
6,309,125 B1 * 10/2001 Peters ..... A46B 11/0006 401/126
6,508,773 B2 1/2003 Burbank et al.
7,566,185 B2 7/2009 Samuelson et al.
8,556,528 B2 * 10/2013 Gardner ..... A45D 40/265 401/122
8,568,048 B2 * 10/2013 Chan ..... A45D 40/265 401/126
8,783,989 B2 * 7/2014 Weigel ..... A45D 40/24 132/218
2007/0025803 A1 * 2/2007 Dieudonat ..... A45D 40/265 401/127
2010/0003065 A1 * 1/2010 Haan ..... A45D 40/265 401/124
2012/0151704 A1 6/2012 White
2013/0184741 A1 7/2013 Laroya et al.
2014/0016984 A1 * 1/2014 Kim ..... A45D 40/265 401/129
2014/0105665 A1 4/2014 Wright et al.

* cited by examiner

*Primary Examiner* — Jennifer C Chiang
*Assistant Examiner* — Joshua Wiljanen

(57) ABSTRACT

Disclosed herein are various embodiments of devices for retrieving and applying product from within a container. In one embodiment the device comprises a shaft having a proximal and distal end; a cap positioned at the proximal end of the shaft; a movable tip positioned at the distal end of the shaft; and a deployment mechanism coupled with the cap near the proximal end and with the tip near the distal end of the shaft. The tip may be rotatably coupled to the deployment mechanism near the distal end of the shaft and configured to move between a first and second position.

15 Claims, 7 Drawing Sheets

COSMETICS RETRIEVAL DEVICE AND APPLICATOR

CLAIM OF PRIORITY

This application claims priority to Provisional Application Ser. No. 62/145,610, filed on Apr. 10, 2015, entitled "COSMETICS RETRIEVAL DEVICE AND APPLICATOR," the entire contents of which are incorporated herein by reference.

TECHNICAL FIELD

This application is directed, in general, to a device and, more specifically, to a retrieval device and applicator for retrieving a remainder of product from within a container that have heretofore been unreachable or irretrievable.

BACKGROUND

Cosmetic and beauty products come packaged in a variety of containers, having a variety of shapes and sizes. Certain products have an applicator such as a wand which extends into the container for retrieving the product and thereafter applying the product to the intended area, such as, for example, lips. Certain products, such as creams, come in a generally wedge-shaped tube and have a flip-top cap which enables application of the product without removing the lid. Others, such as lip gloss, come generally in a cylindrical container wherein the applicator is a wand attached beneath the cap such that removing and replacing the cap likewise removes and replaces the applicator.

Certain applicators do not always enable removal and retrieval of all of the product within, rendering a certain portion of the product inside generally unusable and often disposed. Cosmetic and beauty products can be very expensive or difficult to obtain and consumers generally would like to know they are receiving a good value for what they have paid for the product. What is needed is a tool that enables retrieval and removal of all product contents within the container such that a consumer is able to more completely access and use the contents of a cosmetic or beauty product such that the consumer receives a better value and product is not wasted.

SUMMARY

The present disclosure provides a product retrieval device and applicator which has a deployable tip that can more effectively and completely retrieve product from within a container, including previously inaccessible areas including the bottom, sides, and the top.

In one aspect of the invention, there is provided one embodiment of a device for retrieving and applying product from within a container, the device comprising a shaft having a proximal and distal end; a cap positioned at the proximal end of the shaft; a movable tip positioned at the distal end of the shaft; and a deployment mechanism coupled with the cap near the proximal end and with the tip near the distal end of the shaft. The tip may be rotatably coupled to the deployment mechanism near the distal end of the shaft and configured to move between a first and second position.

In another aspect, there is disclosed a system. The system comprises a container configured for containing a product therein and a device for retrieving and applying product from within a container. The device comprises a shaft having a proximal and distal end; a cap positioned at the proximal end of the shaft, the cap comprising a button; a movable tip positioned at the distal end of the shaft; and a deployment mechanism coupled with the cap near the proximal end and with the tip near the distal end of the shaft. The tip may be rotatably coupled to the deployment mechanism near the distal end of the shaft and configured to move between a first and second position.

BRIEF DESCRIPTION

Reference is now made to the following descriptions taken in conjunction with the accompanying drawings, in which.

DETAILED DESCRIPTION

Cosmetic and beauty products come in a variety of containers with a variety of dispensers, caps, applicators, and the like. Lip gloss, for example, is generally packaged in a cylindrical container having a wand secured beneath a cap. The wand extends into the container and works to retrieve the gloss and thereafter apply the gloss to a user's lips. While the wand provides for retrieving and applying the gloss, the wand is not effective for retrieving all of the gloss from the container, most noticeably in the bottom of the container, along the sides thereof, and near the top of the container. For example, in order for the wand to fit inside the container when the top is closed completely, the wand may not reach the bottom of the container once the top is unscrewed upwards. Also, while the wand may sometimes be manipulated around the inside the container, the texture and density of the lip gloss generally prevents complete retrieval of the gloss from the sides of the container. The user generally must purchase a new lip gloss and throw away a used lip gloss having a significant amount of product left (about 20 percent or more) remaining because the remaining product is irretrievable by the wand.

Other cosmetic and beauty products have a similar problem in that pumps, applicators, and wands are generally ineffective at retrieving all of the product from within, including other products in cylinders similar to gloss, and products in tubes such as creams and the like. As a result, most product containers are disposed having about 20 percent or more of product inside, which while still good and useable, cannot be retrieved and therefore ultimately wasted and unused. Some attempts to better retrieve product from within cosmetic containers include, for example, a wand having extra length and a flexible tip at the distal end thereof, a threaded platform positioned at the bottom of the container which rises as product is used, and a user may attempt to cut open or invert the container. However, none of the foregoing solutions provide for effective or substantial retrieval of product from at least the bottom, sides of a container, or near the top thereof, and cannot be secured with or used in place of the existing cap or top.

Figure 1:
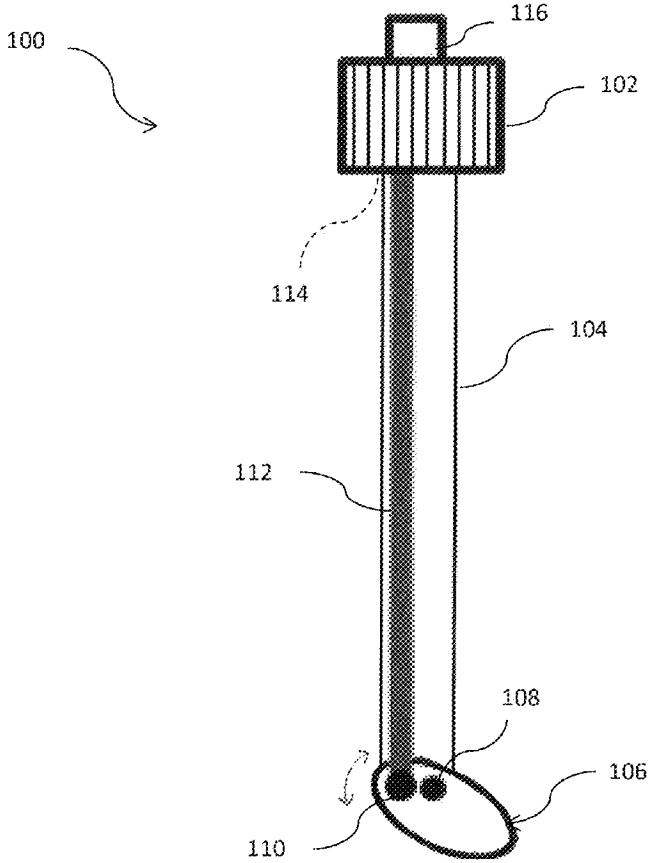
FIG. 1 is a side view of one embodiment of a device according to the present disclosure.

Disclosed herein are embodiments of cosmetic devices and tools which provide for more substantial retrieval and use of cosmetic products from within containers. Referring to the drawings, and more specifically, FIG. 1, there is shown a cosmetic device 100 representing one embodiment of the present disclosure. The device 100 comprises a cap 102 having a shaft 104 attached therebelow. The shaft 104 comprises a proximal and distal end, wherein the proximal end may be coupled beneath or incorporated with the cap 102. A moveable tip 106 may be coupled at the distal end of the shaft 104.

The tip 106 may have a length equal to at least the radius or width of the cap 102, or similarly, at least half the radius of a container into which the tip 106 may be inserted. The tip 106 may be moveable such that when the device 100 is inserted into a container, such as, e.g., a lip gloss tube, the tip 106 is at a first position, linear with the shaft 104. Once inserted into the container, the tip 106 may be deployed into at least a second position as shown in FIG. 1 wherein the tip 106 rotates up and outward to an angular position. In some embodiments, the angle may be at or greater than 35 degrees with respect to the shaft 104 and adjustable up to about 90 degrees such that the tip 106 may be about perpendicular with the shaft 104. In some embodiments, the angle may exceed 90 degrees, if necessary, when, for example, the proximal end of a container may be angled.

The tip 106 may be coupled to shaft 104 via a plurality of fastening joints, including at least a first fastening joint 108 and a second fastening joint 110. The first fastening joint 108 may be fixed such that the tip 106 pivots about first fastening joint 108. Coupled with second fastening joint 110 may be a rod 112 extending along or within the shaft 104 from a deployment mechanism 114 at the proximal end of the shaft 104. The deployment mechanism 114 may be secured beneath the cap 102 or may be incorporated as a component of the cap 102. To deploy the tip 106 from the first position, a user engages the deployment mechanism 114 which moves the rod 112 downward and thereby moving second fastening joint 110. As the second fastening joint 110 moves, the tip 106 pivots about the first fastening joint 108 and extends outward at an angle relative to the distal end of the shaft 104. To return the tip 106 back to the first position, the deployment mechanism 114 is engaged again and the rod 112 returns upward, which pivots the tip 106 back into the first position. The second fastening joint 110 may couple and move along the distal end of the shaft 104 via a fastener having a moveable arm, or in some embodiments, the second fastening joint 110 may be coupled directly to the rod 112 and travel within or along a defined path along the distal end of the shaft 104.

In some embodiments, the deployment mechanism may comprise a button 116 which extends from cap 102 for engagement of the deployment mechanism. In some embodiments, the button 116 may be incorporated as part of the cap 102, such as a flexible, depressible center, or other possible configurations known to those skilled in the art. In other embodiments, the button 116 may be threaded such as to engage a twist activated deployment mechanism.

In some embodiments, the deployment mechanism 114 may comprise a cam activated mechanism that rotates and engages the rod 112. In other embodiments, the deployment mechanism 114 may be twist activated, whereby the deployment mechanism 114 and button 116 are threaded such that rotating the button 116 may similarly engage and rotate the rod. In still other embodiments, the deployment mechanism may comprise a spring-loaded mechanism for engagement with and deployment of the rod 112. A lug may be positioned between the deployment mechanism 114 and spring. In yet other embodiments, the deployment mechanism 114 may comprise a tension fit mechanism for deploying the rod 112 to various fixed positions. In embodiments having a tension fit deployment mechanism, contact with the bottom of the container by the tip 106 may engage the deployment mechanism and deploy the tip 106 outward.

When the tip 106 is extended at an angle relative to the distal end of the shaft 104, the tip 106 may reach the sides of the container such that substantially more product may be retrieved and thereafter used. In some embodiments, the tip 106 may comprise a base and a replaceable head. The base of the tip 106 may be secured to the shaft 104 via a plurality of fastening joints similar to the embodiment shown in FIG. 1. The replaceable head may fasten to the base by a snap fit, threaded fit, tension fit, or other fastening methods which enable the head to be removed and replaced with a new head. In some embodiments, the replaceable head and the base may comprise the same or similar materials, such as polymers, rubber, plastics, and other durable materials which can be easily sanitized and likewise enable application of a cosmetic product to a facial feature, such as applying lip gloss to lips. In some embodiments, the replaceable head may comprise a covering such as a sponge, rubber, or similar soft materials used in cosmetic applicators.

In some embodiments, while not shown, cosmetic device 100 may also comprise a housing into which device 100 may be inserted and stored while not in use in a cosmetics container.

The shaft 104, tip 106, and various other components of cosmetic device 100 may comprise plastics, polymers, such as, e.g., polypropylene (PP), polyethylene (PE), polystyrene (PS), and polyethylene terephthalate (PET), and acrylics similar to those currently used in cosmetic and beauty applicators and containers. Some components may comprise a high gloss or UV coating. The rod 112 and cap 102 may comprise similar plastics, polymers, acrylics as discussed above, and metals suitable for use with cosmetic and beauty products. The first and second fastening joints may comprise screws, rivets, and other mechanical fasteners which may be formed from plastics and polymers as discussed above, or coated metals which may be used with cosmetic and beauty products.

Figure 2:
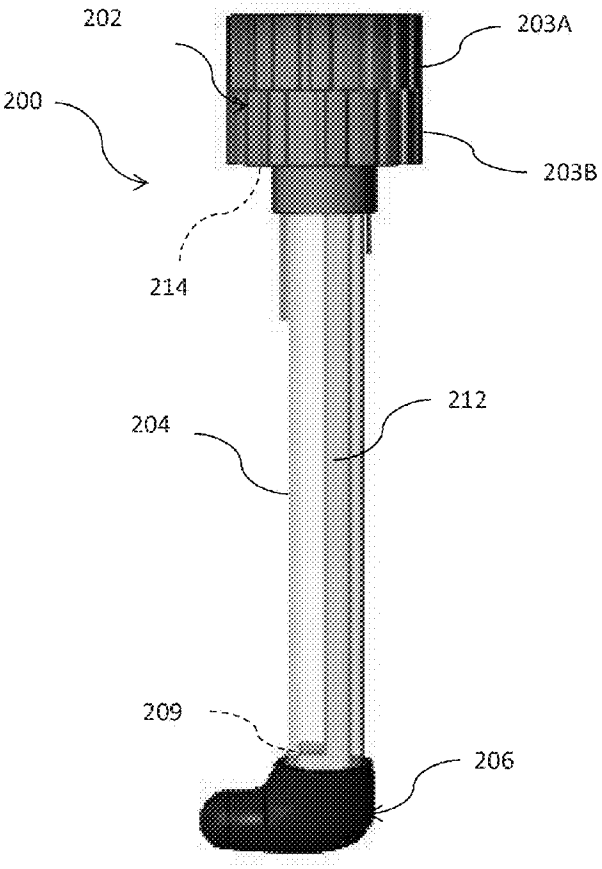
FIG. 2 is a perspective view of another embodiment of a device according to the present disclosure.

Referring now to FIG. 2, there is shown another embodiment of a cosmetic device 200 according to the present disclosure. Cosmetic device 200 comprises a cap 202 which may comprise at least a top member 203A and a bottom member 203B. Top member 203A may be rotatably coupled with bottom member 203B. In some embodiments, top and bottom member 203A and 203B may rotate in opposing directions, while in other embodiments, top member 203A may rotate while bottom member 203B remains in a fixed position. A tip 206 may be coupled at a distal end of shaft 204 via at least one fastening joint 209. A rod 212 may be secured at the proximal end of the shaft 204 to a deployment mechanism 214 and to the at least one fastening joint 209 at the distal end. In this embodiment, the deployment mechanism 214 may be twist activated such that by rotating at least the top member 203A, a cam comprising the deployment mechanism 214 engages the rod 212 downward and thereby rotates tip 216 outward with respect to the distal end of shaft 204.

Figure 3:
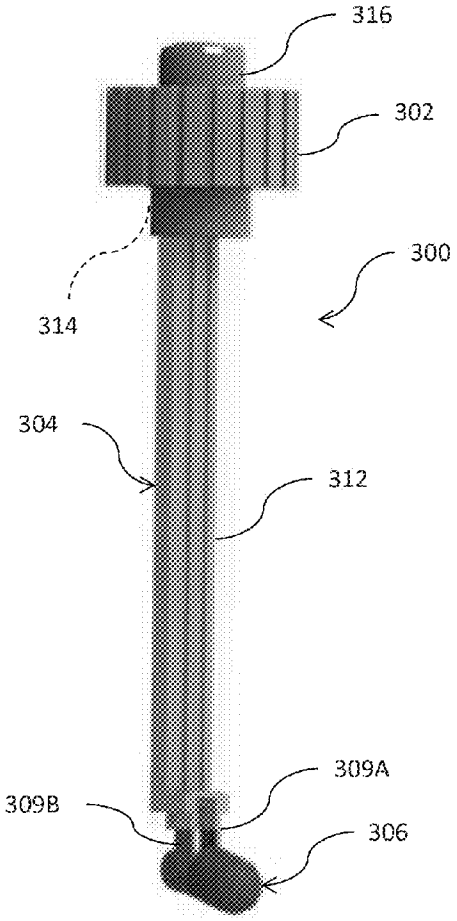
FIG. 3 is a perspective view of yet another embodiment of a device according to the present disclosure.

Referring now to FIG. 3, there is shown another embodiment of a cosmetic device 300. Cosmetic device 300 similarly comprises a cap 302 having a shaft 304 attached thereto, the shaft having a proximal and distal end. A tip 306 may be coupled with the distal end of shaft 304 via a plurality of fastening joints, comprising at least fastening joints 309A and 309B. Fastening joints 309A and 309B may be coupled with a tension rod 312 which connects with a deployment mechanism 314. The tension rod 312 may in some embodiments comprise a cable secured within a housing of shaft 304, and in other embodiments, the tension rod 312 may be the shaft 304. A button 316 engages deployment mechanism 314 and rotates the plurality of fastening joints 309A and 309B such that tip 306 rotates outward at an angle with respect to the shaft 304.

Referring now to FIG. 4A-4E, there are shown various views of yet another embodiment of a cosmetic device 400. Device 400 comprises a cap 402 having a shaft 404 coupled below. The shaft 404 comprises a proximal and distal end, wherein the proximal end may be coupled to or beneath cap 402. A moveable tip 406 may be coupled at the distal end of the shaft 404. The tip 406 is deployable between a first position shown in FIG. 4A wherein the tip is linear (0 degrees) with the shaft 404 and a second position shown in FIG. 4B wherein the tip 406 is at a deployed position about perpendicular with the shaft (up to 90 degrees).

Figure 4C:
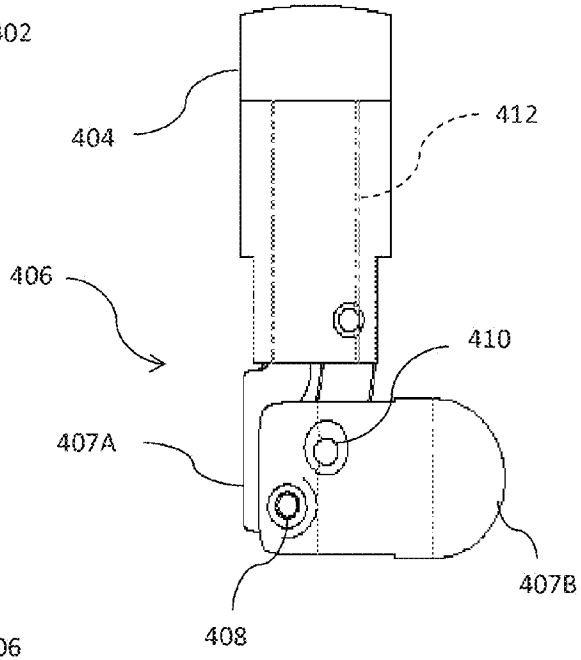
FIG. 4C is a detailed view of a tip component of the device shown in FIG. 4A.
Figure 4B:
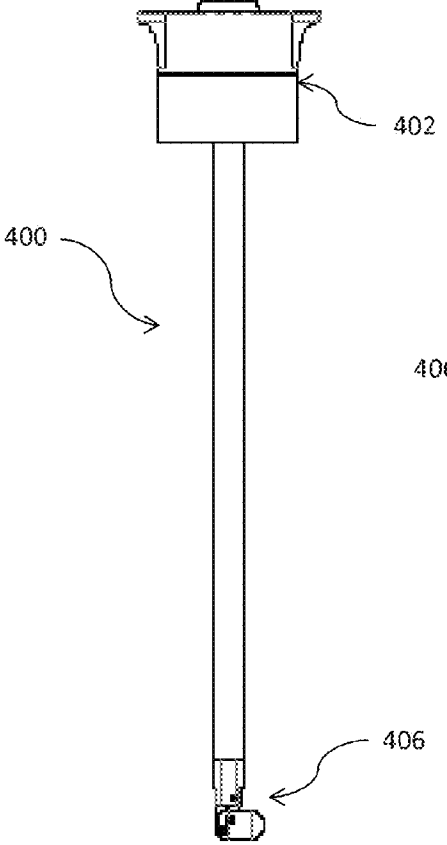
FIG. 4B is a side view of the device shown in 4A shown in a second position.
Figure 4A:
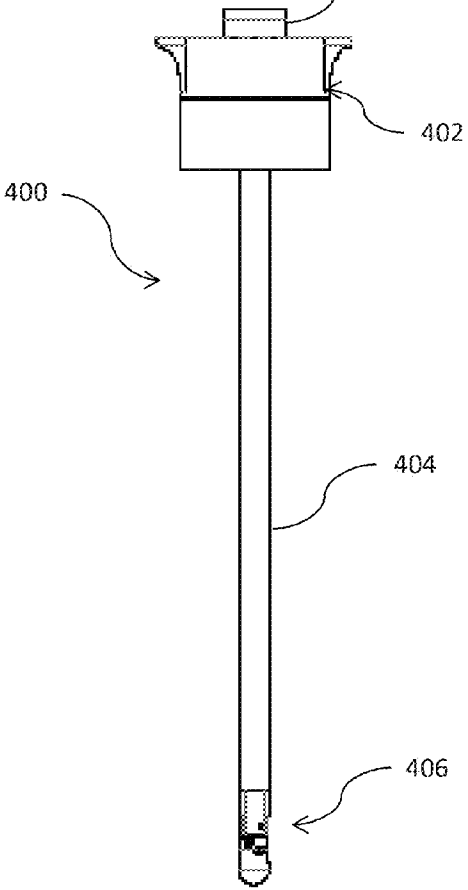
FIG. 4A is a side view of another embodiment of a product retrieval device according to the present disclosure, shown in a first position.
Figure 4F:
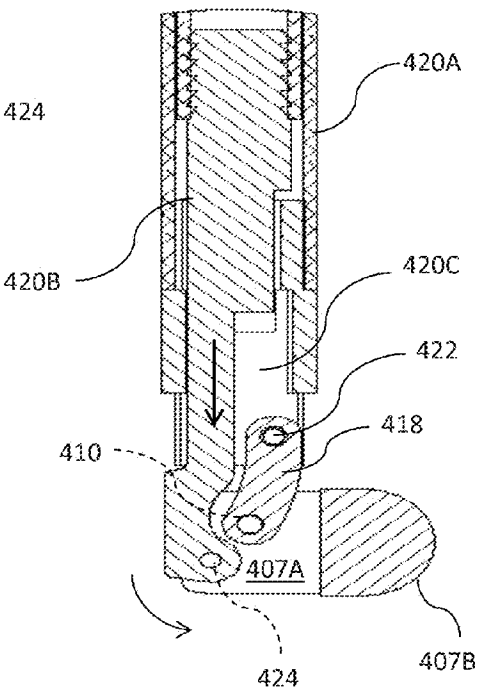
FIG. 4F is a detailed sectional view of a distal end of the device shown in FIG. 4A.
Figure 4E:
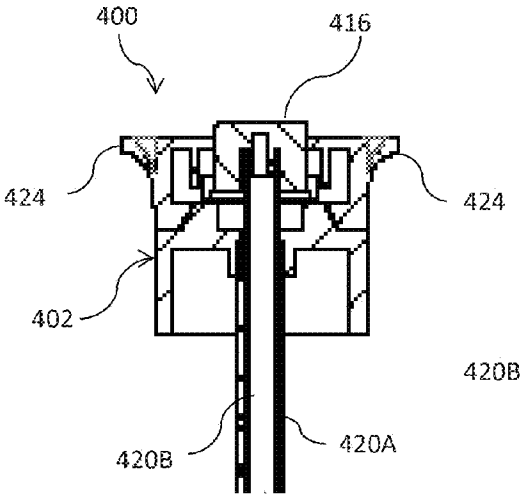
FIG. 4E is a detailed sectional view of a proximal end of the device shown in FIG. 4A.
Figure 4D:
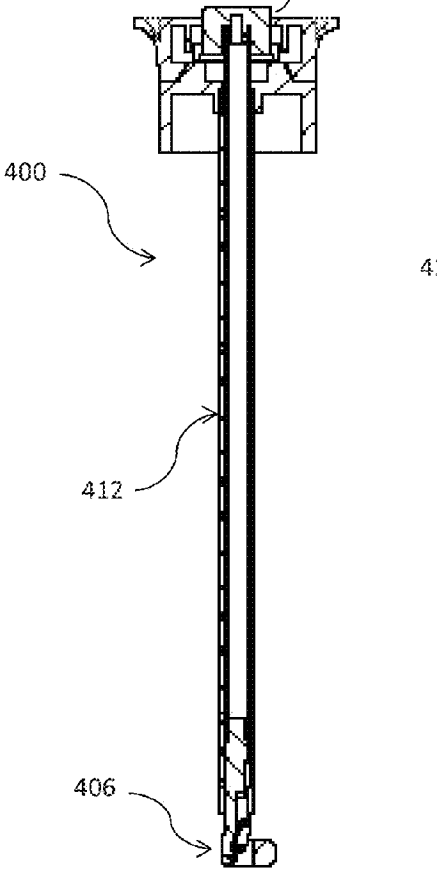
FIG. 4D is a sectional view of the device shown in 4A.

When the tip 406 is deployed to the second position as shown in FIG. 4B, the tip 406 is able to extend outward inside the cosmetic container, such as a lip gloss tube, and retrieve the product from the entirety of the container, including the sides, the distal (bottom) end of the container, and beneath the cap 402 at the proximal (top) end of the container, which previous cosmetic tools and applicators have been unable to access and retrieve the product. The device is returned to the first position to remove the device 400 from the container. The tip 406 can then also be used to apply the retrieved cosmetics.

Referring now to FIG. 4C, there is shown a detailed view of tip 406. Tip 406 comprises a first end 407A and a second end 407B, wherein tip 406 is coupled onto the distal end of shaft 404 on first end 407A and second end 407B may be contoured similar to traditional cosmetic applicator tips. In some embodiments, first end 407A may be configured as a base with second end 407B being removeable, and be attached by a snap fit, tension fit, over-lay, and various other ways a removeable end may be attached or coupled to a base.

Tip 406 may couple to a rod 412 positioned within shaft 404 via a first fastener 408 and a second fastener 410. First fastener 408 may couple to rod 412 via a coupling 418 which fastens onto the distal end of the rod 412 via a third fastener 420. The first fastener 408, second fastener 410, and third fastener 420 may all rotate to enable the tip 406 to rotate from zero-degrees, the first position shown in FIG. 4A, to 90-degrees, a deployed position shown in FIGS. 4B and 4C, and various positions therebetween.

To move the tip 406 from the first position to the second position, or various possible positions therebetween, a deployment mechanism 414 may comprise a button 416 on cap 402, which is pressed downward to engage rod 412 downward toward the distal end of shaft 404. As the rod 412 moves down, the first fastener and 408 and second fastener 410 rotate and coupling 418 pivots inward, causing the first end of tip 407A to move downward as second end of tip 407B pivots outward at an angle toward the 90-degree deployed second position. The user maintains pressure on button 416 while the device 400 is rotated and the tip 406 is rotated within the cosmetic retainer to retrieve product. When the desired amount of product has been retrieved, the user releases the button 416 such that the tip 406 rotates back into the first position so that the device 400 may be removed from the cosmetics container. A spring positioned within the cap 402 beneath the button maintains the button 416 upwards in an un-deployed.

In some embodiments, the button 416 may be secured in a pushed position such that the device may be moved and rotated, keeping the tip 406 deployed in the second position. The deployment mechanism 414 may comprises a spring-loaded mechanism within the cap 402 such that when the button 416 is depressed again, the spring releases and allows the button 416 to return upward to the un-pressed position, returning the tip 406 back to the first position. In other embodiments, the deployment mechanism 414 may comprise a tension fit mechanism within the cap 402 for holding the button 416 in a depressed position. Likewise, other locking methods and components known to those skilled in the art may be utilized.

Referring to FIG. 4C-4F, there are shown sectional views of device 400. The deployment mechanism 414 comprises the rod 412 extending from beneath the cap 402 down to at least the distal end of the shaft 404, and button 416 is pushed down into the cap 402. The rod 412 comprises a plurality of bars 420. A first bar 420A extends the entirety of shaft 404. The first bar 420A is secured within the cap 402 and encloses a second bar 420B. Second bar 420B extends up into the cap 402, mating at one end beneath button 416 of the cap 402 and attaching at an opposing end with the tip 406 via first fastener 408. As button 416 is pushed down, first bar 420A is engaged pushed downward toward the distal end of the shaft 404. Attached to the first bar 420A near the distal end of shaft 404 is a third bar 420C which may remain stationary as second bar 420B moves downward. Coupling 418 is rotatably attached to the third bar 420C via a third fastener 422 which enables tip 406 to pivot outward as the second bar 420B is pushed downward.

The cap 402 may comprise multiple components, including the button 416 and grip tabs 424, which provide stability and facilitate gripping the cap 402 as the button 416 is pressed downward and also facilitate easier gripping as the button is pressed again to disengage the rod 412 and return the tip 406 back to the first position.

Figure 5C:
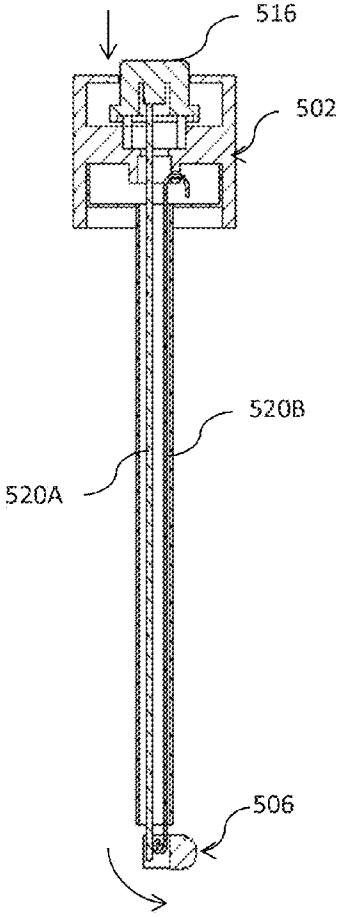
FIG. 5C is a sectional view of the embodiment shown in FIG. 5A in a second position.
Figure 5B:
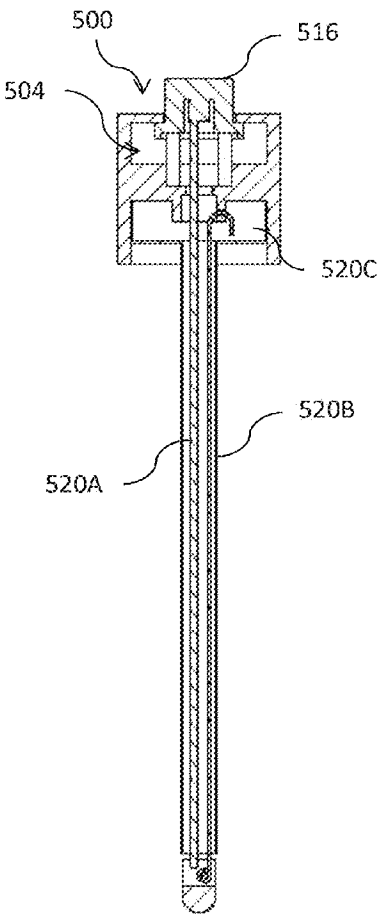
FIG. 5B is a sectional view of the embodiment shown in FIG. 5A in a first position.
Figure 5A:
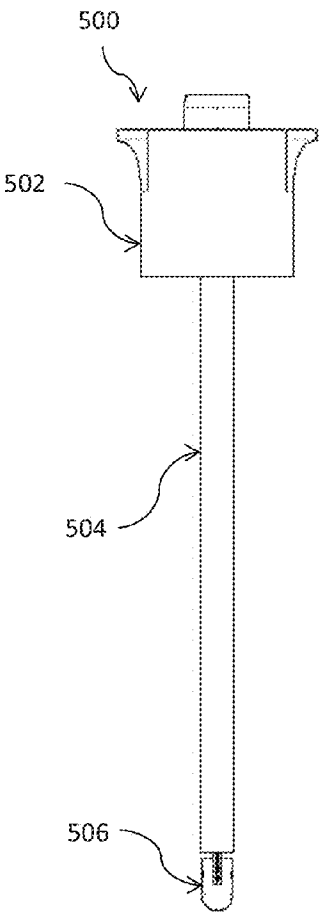
FIG. 5A is a side view of another embodiment of a device according to the present disclosure.

Referring now to FIG. 5A-5C there is shown another embodiment of a cosmetics device 500. Device 500 may comprise similar components as device 400, including cap 502, shaft 504 and moveable tip 506. Device 500 may comprise a deployment mechanism 514 which comprises a button 516 of cap 502 and the shaft 504 comprising a plurality of bars 520A, 520B, and 520C. First bar 520A extends up into the cap 502 and engages button 516 at one end and at the distal end of shaft 504 with tip 506. Second bar 520B couples with stationary bar 520C positioned with the cap 502 at one end and on the other end with tip 506. As the button 516 is pressed downward, the first bar 520A is pushed downward causing tip 506 to pivot outwardly at an angle towards a second deployed position as shown in FIG. 5C. To return the tip 506 to the first position, the button 516 is depressed again releasing the first bar 520A such that tip 506 rotates back into the first position shown in FIG. 5B.

As shown in FIG. 5C, the second position may be such that the tip 506 extends at about a 90-degree angle with respect to shaft 504. However, in certain embodiments, the angle may be between about 35 degrees to greater than 90-degrees, such as, for example, about 135 degrees.

Figure 6C:
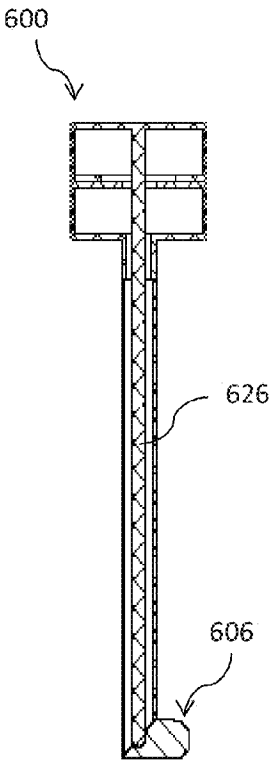
FIG. 6C is a sectional view of the embodiment shown in FIG. 6A in a second position.
Figure 6B:
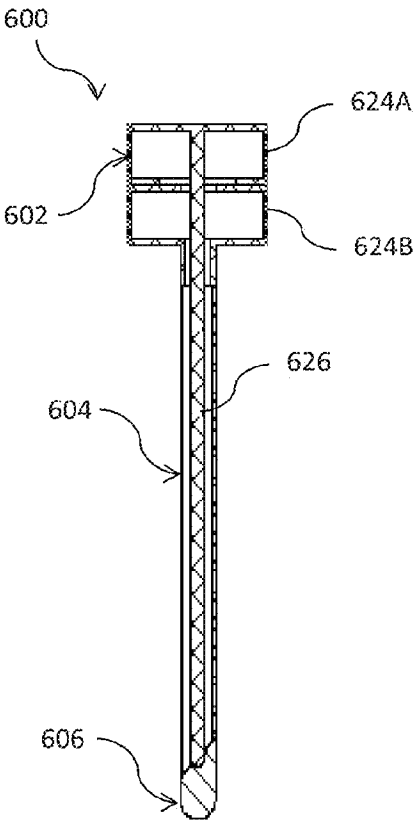
FIG. 6B is a sectional view of the embodiment shown in FIG. 6A in a first position.
Figure 6A:
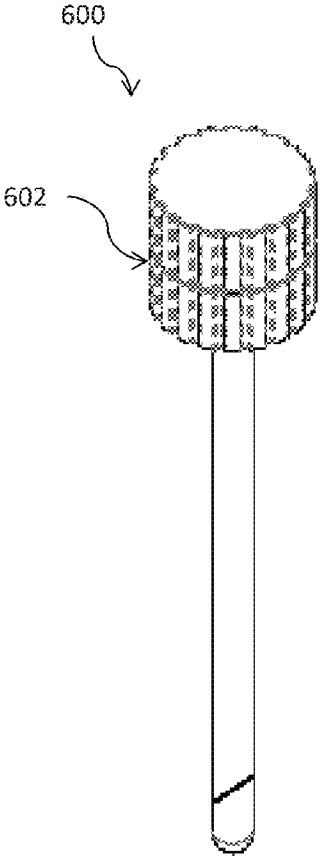
FIG. 6A is a side view of yet another embodiment of a device according to the present disclosure.

Referring now to FIG. 6A-6C, there is shown another embodiment of a cosmetic device 600, having a deployment mechanism having a rotating bar or hinge. Device 600 comprises a cap 602 having two portions, a top portion 624A and a bottom portion 624B, which rotate in opposing directions with respect to each other. A rotating bar 626 is positioned within shaft 604, coupled within the cap 602 at one end and coupled with tip 606 at the other end. The tip 606 and distal end of shaft 604 are shaped angularly such that tip 606 can rotate from a first position as shown in FIG. 6B to a second, deployed position as shown in FIG. 6C. The tip 606 is secured onto the rotating bar 626 such that as top portion 624A is turned, the rotating bar 626 rotates tip 606 angularly outward towards the second position.

Figure 7B:
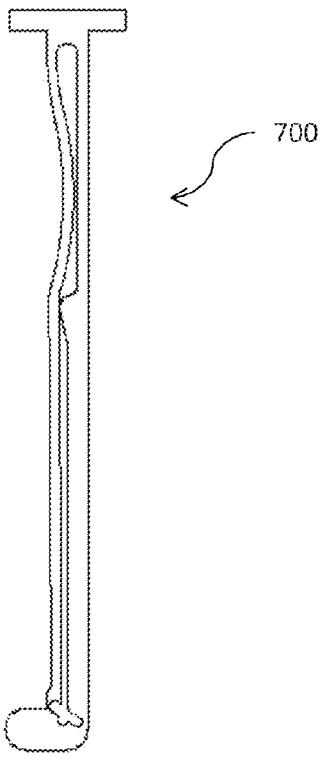
FIG. 7B is a side view of the embodiment shown in FIG. 7A shown in a second position.
Figure 7A:
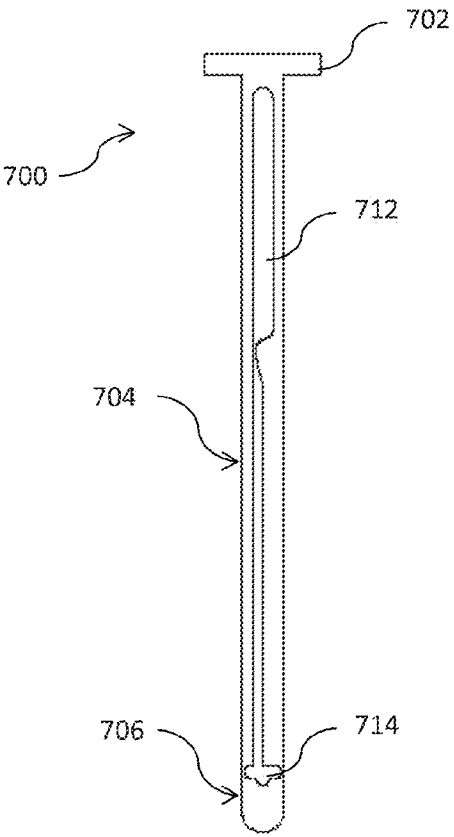
FIG. 7A is a side view of another embodiment of a device according to the present disclosure, shown in a first position.

Referring now to FIGS. 7A and 7B, there is shown yet another embodiment of a cosmetics device 700. Device 700 comprises a cap 702; a flexible shaft 704 having a rod 712 coupled with a living hinge 714 housed incorporated therein, and a moveable tip 706 at the distal end of the rod 704. The tip is coupled onto the shaft via the hinge 714 such that as the shaft 704 is squeezed, the hinge 714 engages and moves the tip 706 outward into a second, deployed position as shown in FIG. 7B. In one embodiment. Device 700 may be fabricated as one flexible instrument, or in another embodiment, the tip may be coupled onto the distal end of the shaft 704 at hinge 714.

While the embodiments shown in FIG. 1-7 relate generally to containers having a cylindrical shape wherein the device may be used in place of the wand and cap provided with the purchased product, other embodiments may comprise a device wherein features including, but not limited to, the tip and cap may be designed to accommodate tube style packaging (such as used commonly for hand creams and moisturizing products) and various other packaging shapes and styles.

In some embodiments, the tip may be replaced in whole, have a replaceable covering fitted over the tip, or the second end of tip, such as second end of tip 407B, may be replaceable for washing and/or disposable. Likewise, various sizes and shapes of tip 406 and second end of tip 407B may be used to accommodate various types of cosmetic products. For example, a device used for lip gloss may use a tip having a rounded, contoured tip as shown in the embodiment described herein, while a device intended for use for eye lashes and brow products, such as mascara and brow gels, may comprise a brush, for example.

In some embodiments, the device may comprise threads beneath the cap such that the device may be used in place of the cap and/or wand which may be initially provided with a cosmetics product; for example, a lip gloss, which includes an applicator wand attached beneath the cap used to seal the lip gloss container. The device described herein may replace the initially provided cap and wand. Similarly, the device may further include a protective sleeve or container for housing the device when not in use and helping protect and keep the device clean and sanitary. In some embodiments, the device may have a length that is longer than the container such that the device, when inserted into the container, can extend the entire length of the container for easier access to the product at the bottom of the container. In system embodiments where the device may replace a traditional wand applicator, the tip may be inserted into the container in a deployed position such that when the cap is unscrewed, the tip may pivot down to a position linear with the shaft to better reach product contained in the bottom of the container.

The disclosure provides in one aspect a device for retrieving and thereafter applying product from within a container, the device comprising a shaft having a proximal and distal end; a cap positioned at the proximal end of the shaft; a tip coupled at the distal end of the shaft; and a deployment mechanism near the proximal end of the shaft having a rod extending therefrom, the rod coupled with the tip near the distal end of the shaft. The tip may be fastened to the distal end of the shaft by at least a first fastening joint and a second fastening joint, wherein the first fastening joint is fixed and the second fastening joint is coupled with the rod and moveable such that as the deployment mechanism engages the rod, the tip rotates the outward at an angle relative to the shaft.

In another aspect, an embodiment of a device may comprise a shaft having a proximal and distal end; a cap positioned at the proximal end of the shaft, the cap comprising at least a top member and a bottom member, wherein the top and bottom members rotate in opposing directions; a tip coupled at the distal end of the shaft; and a deployment mechanism near the proximal end of the shaft having a rod extending therefrom, the rod coupled with the tip near the distal end of the shaft. The tip may be fastened to the distal end of the shaft by one or more fastening joints, wherein as the deployment mechanism engages the rod, the one or more fastening joints rotate such that the tip rotates outward at an angle with respect to the shaft.

In some embodiments the deployment mechanism may be twist activated. In other embodiments, the deployment mechanism may comprise a revolving cam. In other embodiments, the deployment mechanism may comprise a spring and further comprise a button extending from the cap.

While the embodiments of the device disclosed herein have been described in conjunction with retrieval and application of cosmetic and beauty products, the embodiments shown and described herein may be equally useful with various other products provided in containers. For example, the device may be used for the retrieval of various products within containers such as, but not limited to, glue, creams, sauces, and various other products provided in containers have limited or no application and retrieval devices.

Those skilled in the art to which this application relates will appreciate that other and further additions, deletions, substitutions and modifications may be made to the described embodiments.

The invention claimed is:

1. A device for retrieving and applying product from within a container, the device comprising:

a shaft having a proximal end and a distal end;

a cap positioned at the proximal end of the shaft;

a movable tip positioned at the distal end of the shaft; and a deployment mechanism coupled with the cap near the proximal end and with the tip near the distal end of the shaft, wherein the deployment mechanism comprises a push-button incorporated into the cap and a rod coupled beneath the button and extending to at least the distal end of the shaft, wherein the rod is configured to move downward towards the distal end of the shaft as the push-button is pressed downward, thereby deploying the tip outward at an angle relative to the shaft;

wherein the rod comprises a plurality of bars:

a first bar extends from the proximal end of the shaft to the distal end of the shaft;

a second bar enclosed within the first bar, the second bar extending up into the cap, mating beneath the push-button at one end and coupled with the tip at an opposing end via a first fastener;

a third bar attached to the first bar near the distal end of shaft; and a coupling rotatably attached to the third bar; and wherein the tip is rotatably coupled to the deployment mechanism near the distal end of the shaft and configured to move between a first and second position.

2. The device according to claim 1, wherein the tip is coupled to the rod at the distal end of the shaft by at least a first fastening joint and a second fastening joint.

3. The device according to claim 2, wherein the first fastening joint is fixed and the second fastening joint is moveably coupled with the rod such that as the deployment mechanism engages the rod toward the distal end of the shaft, the tip, initially positioned at the first position, rotates outward at an angle relative to the shaft to the second position.

4. The device according to claim 3, wherein the second position of the tip is about a 90 degree angle relative to the first position.

5. The device according to claim 1, wherein the tip comprises at least a first and second portion, wherein the second portion is removable and replaceable.

6. The device according to claim 1, wherein the tip comprises a synthetic sponge covering.

7. The device according to claim 1, wherein the tip comprises a removable brush.

8. A device for retrieving and applying product from within a container, the device comprising:

a shaft having a proximal end and a distal end;

a cap positioned at the proximal end of the shaft;

a movable tip positioned at the distal end of the shaft; and a deployment mechanism coupled with the cap near the proximal end and with the tip near the distal end of the shaft, wherein the deployment mechanism is a hinge incorporated into the shaft, wherein the shaft is flexible and configured to activate the hinge when the shaft is squeezed near the proximal end;

wherein the tip is rotatably coupled to the deployment mechanism near the distal end of the shaft and configured to move between a first and second position.

9. A system, comprising:

a container configured for containing a product therein; and a device for retrieving and applying product from within a container, the device comprising:

a shaft having a proximal and distal end;

a cap positioned at the proximal end of the shaft, the cap comprising a button;

a movable tip positioned at the distal end of the shaft; and a deployment mechanism coupled with the cap near the proximal end and with the tip near the distal end of the shaft, wherein the deployment mechanism comprises a push-button incorporated into the cap and a rod coupled beneath the button and extending to at least the distal end of the shaft, wherein the rod is configured to move downward towards the distal end of the shaft as the push-button is pressed downward, thereby deploying the tip outward at an angle relative to the shaft;

wherein the rod comprises a plurality of bars:

a first bar extends from the proximal end of the shaft to the distal end of the shaft;

a second bar enclosed within the first bar, the second bar extending up into the cap, mating beneath the push-button at one end at coupled with the tip at an opposing end via a first fastener;

a third bar attached to the first bar near the distal end of shaft; and a coupling rotatably attached to the third bar; and wherein the tip is rotatably coupled to the deployment mechanism near the distal end of the shaft and configured to move between a first and second position.

10. The system according to claim 9, wherein the tip is coupled to the rod at the distal end of the shaft by at least a first fastening joint and a second fastening joint.

11. The system according to claim 10, wherein the first fastening joint is fixed and the second fastening joint is moveably coupled with the rod such that as the deployment mechanism engages the rod toward the distal end of the shaft, the tip, initially positioned at the first position, rotates outward at an angle relative to the shaft to the second position.

12. The system according to claim 11, wherein the second position of the tip is about a 90 degree angle relative to the first position.

13. The system according to claim 9, wherein the tip comprises at least a first and second portion, wherein the second portion is removable and replaceable.

14. The system according to claim 9, wherein the tip comprises a synthetic sponge covering.

15. The system according to claim 9, wherein the tip comprises a removable brush.

* * * * *